US006737616B1

(12) United States Patent
Sherrill

(10) Patent No.: US 6,737,616 B1
(45) Date of Patent: May 18, 2004

(54) OPEN COIL ELECTRIC RESISTANCE HEATER USING TWISTED RESISTANCE WIRES AND METHODS OF MAKING

(75) Inventor: James L. Sherrill, Cookeville, TN (US)

(73) Assignee: Tutco, Inc., Cookeville, TN (US)

( * ) Notice: Subject to any disclaimer, the term of this patent is extended or adjusted under 35 U.S.C. 154(b) by 0 days.

(21) Appl. No.: 10/404,086

(22) Filed: Apr. 2, 2003

(51) Int. Cl.[7] ..... H05B 3/06
(52) U.S. Cl. ..... 219/536; 219/537
(58) Field of Search ..... 219/532, 536, 219/537, 539, 552, 476, 477, 478; 338/260, 304, 305, 316, 319, 320

(56) References Cited

U.S. PATENT DOCUMENTS

| | | | | |
|---|---|---|---|---|
| 1,393,325 A | * | 10/1921 | Smith | 338/214 |
| 2,126,155 A | | 8/1938 | Van Dyck | |
| 2,247,869 A | | 7/1941 | Beers | |
| 2,321,021 A | * | 6/1943 | Dyer | 174/128.1 |
| 2,625,666 A | | 1/1953 | Williams | |
| 3,219,872 A | | 11/1965 | Hodge | |
| 3,816,706 A | * | 6/1974 | Meywald | 219/537 |
| 3,904,851 A | | 9/1975 | Gustafson et al. | |
| 4,037,083 A | | 7/1977 | Leavines | |
| 4,144,445 A | * | 3/1979 | Thweatt, Jr. | 219/532 |
| 4,475,996 A | | 10/1984 | Inoue | |
| 4,695,703 A | | 9/1987 | Williams et al. | |
| 5,296,685 A | | 3/1994 | Burstein et al. | |

* cited by examiner

*Primary Examiner*—Edward K. Look
*Assistant Examiner*—Vinod D. Patel
(74) *Attorney, Agent, or Firm*—Clark and Brody

(57) ABSTRACT

An open coil resistance heating apparatus uses a pair of twisted wires having a particular gauge and pitch as the resistance heating wire. Using the twisted pair of wires in the selected gauge and pitch results in significant cost reductions; less wire is needed to achieve the same heating capacity.

19 Claims, 1 Drawing Sheet

OPEN COIL ELECTRIC RESISTANCE HEATER USING TWISTED RESISTANCE WIRES AND METHODS OF MAKING

FIELD OF THE INVENTION

The present invention is directed to an open coil electric resistance heater, and in particular to one that employs a twisted electrical resistance wire pair as the heating element thereof.

BACKGROUND ART

The use of a single resistance wire formed into a helical coil and then used in an electric heater is well known in the prior art. One example of this application is an open coil electric resistance heater as shown in FIG. 1 and designated by the reference numeral 70.

The heater 70 contains a terminal plate 71, a top cross-beam 72, and three bars 60 that are attached to terminal plate 71. Two heating elements (the top one shown as 74) are disposed on opposite sides of bars 60, with double clinch clips 1 being attached to bars 60 (three clips per bar), and two insulators 20 (only one shown) being attached to each clip 1. The bars 60 are attached at one end to the terminal plate 71 at 60*a* and on the opposite end to cross beam 72.

The heating elements 74 are each a continuous length of suitable electrical resistance heating wire, such as Nichrome or the like. Preferably, the heating elements are in the form of longitudinal helical coils of the electrical resistance heating wire with the coils each having a multiplicity of generally uniformly spaced convolutions. The heating element 74 has a plurality (e.g., six in FIG. 1) of heating element runs 76, (the coil underneath that is not shown has the same runs). The adjacent runs of the heating elements are electrically connected in series to an adjacent run of the heating element by a looped end turn 78.

In addition to the runs and looped end turns discussed above, the heating element 74 has leads 80, which constitute the ends of the heating elements and which are electrically connected to respective electric terminals 82 in terminal plate 71. Those skilled in the art will recognize that the terminals 82 may be connected to a source of electrical power (not shown) for energizing heating element 74 in the conventional manner.

Heating element 74, via heating element run 76, is supported on insulators 20, thereby holding heating element 74 clear of bars 60 and supporting the heating elements during energization. Each insulator 20 is secured in clip 1 that is supported in turn by the bar 60. This type of heater is disclosed in U.S. Pat. No. 6,509,554 and is herein incorporated in its entirety by reference as one example of an open coil resistance heater.

In these types of heaters, the resistance coils are energized to heat air passing over the coils, the heated air is then useful for different applications, clothes dryers, etc. This is just an example of one type of an open coil resistance heater and many other types exist, such as ones that employ different types of insulator supports and insulators themselves, such as round bushings, point suspension insulators, or flat bushings.

In other heaters, the resistance wires may be coiled in parallel by feeding the wires into a coiling machine for winding on an arbor. Once formed, the individual leads of each separate wire are terminated into a common terminal, one terminal at each end of the coil. This parallel winding is commonly used in sheathed or tubular electric heating elements.

However, there is an ever-pressing need in the open coil resistance heater industry to cut costs of production and use less weight of material. Thus, there is a need for improvements in these types of heating apparatus so that manufacturers can gain competitive edges over their competitors.

In response to this need, the present invention provides a heater that produces a significant savings in weight of material. The inventive open coil resistance heater uses a twisted wire pair in place of the single resistance wire used in conventional open air resistance heating apparatus. Use of the twisted wire pair in the proper configuration results in material weight saving since less wire is ultimately used in making the heating apparatus and the saving is achieved without a loss in heating capacity.

It should be understood that the invention is not the mere use of twisted wires in resistance heaters. The use of twisted wires in electric resistance heating is disclosed in U.S. Pat. No. 5,296,685 to Burstein and U.S. Pat. No. 3,904,851 to Gustafson. Burstein relates to a radiant quartz heater wherein a twisted resistance wire is encased in a quartz tube, and teaches that the pitch or lay distance should be around 9–11 times the diameter of the individual wire. In Gustafson, twisted wires are wound around an insulator plate and a medium is passed over the plate for heating purposes.

Given the fundamental differences between the operating parameters of a quartz radiant heater and open coil resistance heaters, the wire arrangement of Burstein would not work in an open coil resistance heater. As explained by Gustafson, the operating temperature is around 1000 degrees Centigrade, which is much higher than that employed for open coil resistance heaters.

SUMMARY OF THE INVENTION

It is a first object of the invention to provide an improved open coil resistance heating apparatus.

It is another object of the invention to provide an open coil resistance heating apparatus that uses less resistance wire weight as compared to conventional open air resistance heating apparatus.

Yet another object of the invention is a method of heating a medium passing over open air coils by using a pair of twisted wires as the resistance wires in replacement for a single wire.

Other objects and advantages will become apparent as a description of the invention proceeds.

In satisfaction of the foregoing objects and advantages of the invention, the invention is an improvement in heaters employing coiled electric resistance wires. According to one aspect of the invention, the single coiled resistance wire used as part of a heater can be replaced with a twisted pair of smaller diameter and specified pitch. The heater can be any type of open air resistance wire heater, and relationship between the single wire and the twisted pair is defined by the equation:

$$\text{Gauge (single wire)} + 3.5 = \text{gauge (each wire of pair)}$$

For example, a heater using a 16.5 gauge wire can be replaced with a heater using a pair of 20 gauge wires, without loss of performance. Alternatively, a 16 gauge wire heater can be replaced with a heater employing two 19.5 gauge wires.

The pitch of the twisted pair can vary based on a ratio ranging between 25–40, preferably 30–34, wherein the ratio is the pitch divided by the small wire diameter.

BRIEF DESCRIPTION OF THE DRAWINGS

Reference is now made to the drawings of the invention wherein.

DESCRIPTION OF THE PREFERRED EMBODIMENTS

The invention offers advantages in the field of open air coil resistance heaters in that a significant material weight saving can be realized by replacing the prior art single resistance wires with a twisted pair of wires having a particular pitch and gauge. Using the twisted pair results in less total wire weight being used as compared to single wire heaters, and therefore, less material weight per assembled heater.

Figure 2:
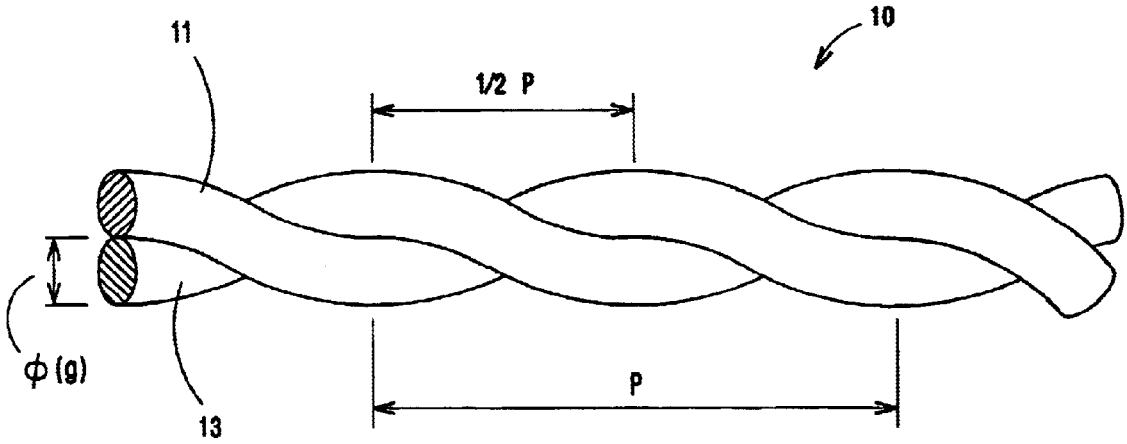
FIG. 2 is a side view of a segment of a twisted wire pair as a resistance heating wire pair for an open air resistance coil heater.

Referring to FIG. 2, a segment of two twisted wires of the invention is designated by the reference numeral 10 and includes wires 11 and 13. The wire diameter or gauge is represented by Ø (g) and the pitch is represented by the letter P. The pitch is the distance of one complete convolution of a given wire. A half pitch measurement, ½ P, is also shown and measured from adjacent peaks of the two different wires.

It should be understood that the invention is not the mere use of twisted wires for resistance heating. Rather, the twisted wires must have the appropriate gauge and pitch so that the pair has the mechanical strength of a single wire. In addition, the pair of wires must be sized so that, when the voltage is applied in the context of an open air coil resistance heater, the wires do not overheat.

A key aspect of the invention is the ability to provide the twisted wire pair as a substitute for a conventional single wire without a loss of heating capacity; but at the same time, a weight savings in the ability to use less wire.

The following theoretical analysis addresses the situation where one wire would be replaced with two or more wires while maintaining the same watt loading when using the two or more wires. The bundle of wire should have the same resistance as the single wire to ensure that the watt loading for either is generally the same. In other words, the bundle of wires is designed to have the same surface area (or watt loading) as the single wire so that the bundle of wires dissipates the same amount of heat as the single wire, and the heater performance is the same or similar when using the bundled wires.

Assume that the diameter of a conventional heater wire is D. Assume that the diameter of each replacement wire is "d", $\eta$ represents the number of replacement wires, "R" represents the resistance of the single wire, and "r" represents the resistance of each replacement wire. Further, use W as the wattage of a single wire, w as the wattage of each replacement wire, L as the length of a single wire, and "l" as the length of each replacement wire. The following equations apply:

(1) $\eta \times R = r$ (2) $W = \eta \times w$ (3) $l/L = \eta \times d^2/D^2$ (4) $d = D/(\eta^2)^{1/3}$ To substitute a single wire of diameter D with a bundle of $\eta$ or more resistance wires ($\eta$ being 2 or more and assuming that the wires are of the same material, use equation (4) to approximate the wire size d for a select $\eta$ and D.) For example, if you have a resistance heater using 0.050 inch diameter wire, and it is desired to use two wires, calculate "d" using 0.050 inch as D and 2 as $\eta$. Knowing "d", one can select the available diameter of resistance wire that is closest to "d", and then use "d" of the actual wire in equation (3) to determine the length ratio l/L.

Using the above formulation and two wires ($\eta$=2) results in the d/D ratio of about 0.63. What this means is that the diameter of the smaller wires are 63% of the diameter of the single wire to be replaced. Since diameter is a function of weight, this is also reflective of weight savings.

The problem with this approach is that when wires are bundled together using this cube root relationship (formula (4)), the wires radiate against themselves instead of radiating to the surrounding environment. As a result, the wires get too hot, and the operating temperature of the heater increases. This increase in operating temperature reduces the life of the resistance wire. In addition, since the bundled wire is intended to replace a single wire with an established operating temperature, other changes may be required, e.g., thermostats may require recalibration, extra insulation may be required to protect other parts of the apparatus using the heater due to increased radiant heat, etc.

Another problem with this approach is that gauge of wires is fairly well defined in the industry. The B&S number for gauges, e.g., 0 to 48, defines industry established wire diameters that are readily available. For example, a B&S number of 20 equates to a wire diameter of 0.02196 inches. Since these numbers are well recognized, a further explanation is not necessary for understanding of the invention. Half sizes are also available, and their size can be determined by extrapolating between the adjacent sizes. Thus, a smaller wire size may not be readily available based on a given single wire diameter and the calculation above.

Nevertheless, the inventor has discovered that a twisted wire pair can be used in an open air electrical resistance heater in replacement for a single wire if the following is followed:

$$\text{Gauge (single wire)} + 3.5 = \text{gauge (each smaller wire)} \quad (5)$$

For example, if a heater is using 16.5 gauge wire, then a pair of 20 gauge wires in a twisted orientation following the ratio regarding pitch as noted above can be used to produce a heater operating at the same or less capacity. Another example would be if the single wire heater B&S gauge was 10, the twisted pair would use 13.5 gauge. Other scenarios within the range of B&S gauges of 0 to 48 could be used as well.

It is preferred to use two wires rather than three or more than three. If more than two wires are used, a cavity is formed in the midst of the multiple wires, and overheating can occur. With just two wires, formation of a cavity is eliminated and the overheating problem does not exist. With two wires, at most there is a gap between the wires, but no interfering surfaces to prevent heat from escaping from the gap. In a three wire bundle, the wires themselves can trap heat, and cause an overheating condition. Further, the weight saving realized with just two wires is offset when using three or more wires.

While it is important to maintain the gauge relationship outlined above, the invention also entails the selection of the proper pitch for the twisted wires. In this regard, the pitch is measured in terms of a ratio RA of the pitch P divided by the smaller wire diameter used in the twisted pair (RA=P/d). For the invention, this ratio ranges between about 25 and 40 with a more preferred range of between 30 and 34. For example, if the wire size Ø (g) is 0.03390 inches (19.5 gauge), and the ratio is selected as thirty, the pitch P is 1.088 inches. In terms of gauge, it is preferred that the gauges for the small diameter wires range between 16.0 to 21.0, even though it is possible depending on the heater application for the small diameter wires to go outside this preferred range, e.g., 10–16, 25–48, 10–25 or even other ranges within the B&S range of 0 to 48.

It is preferred to specify the pitch by using the selected gauge and range of the ratio as outlined above. This preference is based on the fact that wire gauges are available in standard sizes as is well known in the heater industry, e.g., an exemplary gauge would be 19½ or 0.03390 inches. For such a gauge and a ratio of 33, an exemplary pitch would be about 1.125. The following table shows the various pitches based on different ratios and wire diameters.

TABLE 1

| Wire diameter (gauge | Pitch for a Ratio of 25 | Pitch for a Ratio of Ratio 30 | Pitch for a Ratio of Ratio 34 | Pitch for a Ratio of Ratio 40 |
|---|---|---|---|---|
| 0.04804" (16.5) | 1.201" | 1.4412" | 1.6333" | 1.9216" |
| 0.04536" (17.0) | 1.134" | 1.3608" | 1.5422" | 1.8144" |
| 0.04030" (18) | 1.0075" | 1.209" | 1.3702" | 1.612" |
| 0.03589" (19) | 0.8973" | 1.0767" | 1.22026" | 1.4356" |
| 0.02846" (21) | 0.7115" | 0.8538" | 0.9676" | 1.1384" |

Based on Table 1, the pitch can range from about 0.70 inches to as much as about 2.00 inches for B&S gauges of 16.5–21, although in certain instances the pitch may go outside these limits if different gauges are used. In a preferred mode, the pitches will be around a little less than around 1.0 inch to around 1.5 inches, thus being in concert with popular heaters that use 16 or 16.5 gauge single wires.

The invention also contemplates the methodology of replacing the sole wire in an open air resistance heating apparatus with two wires, by using the formulas above. That is, based on an initial wire diameter and a given heater size, equation (5) is used to obtain the smaller diameter wire size, and the pitch is determined using the ratio ranges described above. The resistance heater is made using this twisted wire pair of small diameter wire, and operated under the same conditions as used for the single wire resistance heating apparatus. The outcome is virtually the same heating capability, but with a significant reduction in the cost of manufacturing the apparatus since less resistance wire is used.

The invention also does not suffer from the problem of parallel wires wound on an arbor. These parallel wire arrangements suffered from a lack of stability and were not capable of use in an open coil heater.

As mentioned above, the use of the twisted wire pair results in using less weight of wire while maintaining similar heating capacity. This weight savings is less than the theoretical savings is 63% outlined above, and, based on the formula (5) and pitch ranges, the actual savings translates to about 20% as is demonstrated by the experiments discussed below.

Testing was performed to verify the weight savings without compromising heater performance. A miniature heating apparatus was made using 16.5 gauge C grade wire (0.048 inches in diameter and 90.978 watts/in$^2$), and a 0.625 inch arbor for winding. The wire weight was 0.2144 pounds. For comparison purposes, another apparatus was made using two 20 gauge C grade wires (0.032 inch diameter and 76.071 watts/in$^2$), and a 0.625 inch arbor for winding. The wire weight was 0.171 pounds (0.0855 pounds per each wire). The apparatus were operated at 22.5 amps with air flow.

A second comparison was made using 16 and 19.5 gauge wires. One miniature heating apparatus was made using 16 gauge C grade wire (0.051 inches in diameter and 76.532 watts/in$^2$), and a 0.625 inch arbor for winding. The wire weight was 0.2703 pounds. For comparison purposes, another apparatus was made using two 19.5 gauge C grade wires (0.034 inch diameter and 63.241 watts/in$^2$), and a 0.625 inch arbor for winding. The wire weight was 0.2178 pounds (0.1089 pounds per each wire). The apparatus were again operated at 22.5 amps with air flow.

Referring to the Table 2 and comparing the weights of the wires, it is plainly seen that about a 20% savings is realized when replacing the single wire with the twisted wire pair.

TABLE 2

| type and number of wires used in heater | total weight of wire | weight savings in lbs. (one and two wire heaters) | percentage weight savings |
|---|---|---|---|
| one wire 16.5 gauge (0.048") | .2144 lbs. | 0.0434 lbs | 20.25% |
| two wires 20 gauge (0.032") | .1710 lbs. | | |
| one wire 16 gauge (0.051") | .2703 lbs. | 0.0525 lbs | 19.42% |
| two wires 19.5 gauge (0.034") | .2178 lbs. | | |

Moreover, when the 16 gauge and 19.5 gauge heaters were tested for 242,290 cycles, the heater using the twisted wire compared favorably to the 16 gauge wire; each heater was still performing adequately. This shows that no loss in performance occurs with the twisted wire heater, so that the weight savings of resistance material is significant.

Figure 1:
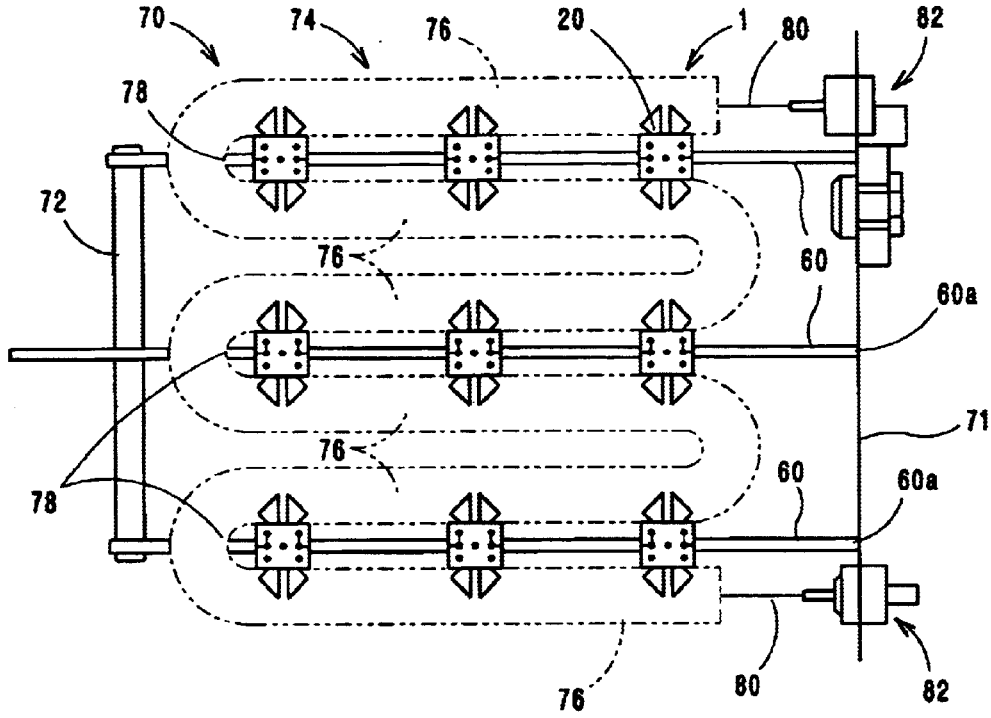
Fig. 1 Prior Art
FIG. 1 is a plan view of a prior art open air resistance coil heater.

While the invention is described for use in a heating apparatus as shown in FIG. 1, the twisted wire pair is adaptable for any type of open coil resistance heating apparatus, including those that may use a dual coil arrangement, and have different mounting arrangements.

Although the formulation set forth above to determine the size of the pair of small diameter wires from a single wire uses B&S gauges, this formulation is also applicable when using other standards for wire sizes such as SWG or metric wire sizes. SWG wires sizes range from 0 to 49, but an SWG number does not necessarily correspond to a B&S number. Metric sizes are connoted by the actual wire diameter, e.g., 6.0 mm, 1.8 mm, and down to as small as 0.050 mm. Thus one would have to relate the single wire SWG gauge or metric size to the B&S gauge prior to using the formulation. One of skill in the art can readily use the disclosed formulation of B&S+3.5 and determine the necessary small wire sizes if using SWG or metric standards. The key is interrelating the starting single wire diameter in the selected standard to an equivalent size in the B&S system of gauges. Knowing the equivalent size in B&S for the single wire, the formula can be applied, and a B&S small wire diameter gauge is generated. This B&S small wire diameter is then used to determine the analogous SWG gauge. Likewise for metric sizes, the starting metric size single wire is used to identify the corresponding B&S gauge. The formula is applied and the result is then used to identify the analogous metric small wire diameter.

As such, an invention has been disclosed in terms of preferred embodiments thereof which fulfills each and every one of the objects of the present invention as set forth above and provides a new and improved open air electric resistance heating apparatus and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In an open coil resistance heating apparatus having a frame with a plurality of insulator supports and a plurality of insulators, the plurality of insulators being spaced apart from each other when each is mounted to a respective insulator support, and at least one resistance wire coil having a helical shape and being mounted on the plurality of spaced-apart insulators with a defined watt loading, wherein the coil has a central axis and is open to atmosphere so that a medium can be directed against the coil for medium heating, the improvement comprising a pair of resistance wires forming the at least one resistance wire coil, the pair of resistance wires twisted with respect to each other to define a pitch.

2. The apparatus of claim 1, wherein the central axis of helical coil follows a serpentine path between terminal ends of the pair of resistance wires.

3. The apparatus of claim 1, wherein a ratio of the pitch of the twisted pair of resistance wires to a wire diameter of each of the pair of resistance wires ranges between 25 and 40.

4. The apparatus of claim 3, wherein the ratio ranges between 30 and 34.

5. The apparatus of claim 3, wherein the central axis of the helical coil follows a serpentine path between terminal ends of the pair of resistance wires.

6. The apparatus of claim 1, wherein, based on the defined watt loading of the heating apparatus and the diameter of the single resistance wire, a size of each of the pair of resistance wires is based on the formula: 3.5 plus a B&S gauge that generally corresponds to the diameter of the single resistance wire equals the size of the each of the pair of resistance wires as measured using B&S gauge.

7. The apparatus of claim 6, wherein a gauge of each pair of resistance wires has a size range when using B&S gauge numbers of between 16.0 and 21.0.

8. The apparatus of claim 1, wherein the pitch of the twisted pair of wires ranges between about 0.70 inches and about 2.00 inches.

9. In a method of heating a medium by forcing the medium across an open coil resistance heating apparatus having a frame with a plurality of insulator supports and a plurality of insulators, the plurality of insulators being spaced apart from each other when each is mounted to a respective insulator support, and at one resistance wire coil having a helical shape and being mounted on the plurality of spaced-apart insulators with a defined watt loading, wherein the coil has a central axis and is open to atmosphere so that a medium can be directed against the coil for medium heating, the improvement comprising heating the medium by providing a pair of resistance wires as the at least one resistance wire coil, the pair of resistance twisted with respect to each other to define a pitch.

10. The method of claim 9, wherein the medium is air.

11. The method of claim 9, wherein a ratio of the pitch of the twisted pair of resistance wires to a wire diameter of each of the pair of resistance wires ranges between 25 and 40.

12. The method of claim 11, further comprising determining the diameter of the single resistance wire based on the defined watt loading, and selecting a diameter for the pair of resistance wires according to the formula:

3.5 plus a B&S gauge that generally corresponds to the diameter of the single resistance wire equals the size of the each of the pair of resistance wires as measured using B&S gauge.

13. The method of claim 9, wherein the pitch of the twisted pair of wires ranges between about 0.70 inches and about 2.00 inches.

14. The method of claim 9, wherein a B&S gauge number of each pair of resistance wires ranges between 16.0 and 21.0.

15. The method of claim 9, wherein the central axis of the helical coil follows a serpentine path between terminal ends of the pair of resistance wires.

16. A method of making a heater having a watt loading based on a single resistance wire in an open coil resistance heater comprising the steps of:

a) identifying a wire diameter of the single resistance wire and a gauge number of the wire diameter in the B&S gauge system;

b) adding 3.5 to the identified B&S gauge number to get a twisted wire B&S gauge number and identifying a wire diameter size for each twisted wire based on the identified twisted wire B&S gauge number and selecting a pair of individual resistance wires corresponding to the identified wire diameter for each twisted wire;

c) twisting the individual resistance wires around each other to form a twisted wire pair have a predefined pitch; and e) using the twisted wire pair in the heater.

17. The method of claim 16, wherein a ratio of the pitch of the twisted pair of resistance wires to a wire diameter of each of the pair of resistance wires ranges between 25 and 40.

18. The method of claim 17, wherein the ratio ranges between about 30 and 34.

19. The method of claim 16, wherein the pitch of the twisted pair of wires ranges between about 0.70 inches and about 2.00 inches.

* * * * *